US012358691B1

(12) United States Patent
Bacher et al.

(10) Patent No.: US 12,358,691 B1
(45) Date of Patent: Jul. 15, 2025

(54) HOLDER FOR PACKAGED FOOD

(71) Applicant: MASONTOPS IP HOLDINGS, INC., Toronto (CA)

(72) Inventors: Michael Bacher, Toronto (CA); Brett Molnar, Toronto (CA)

(73) Assignee: MASONTOPS IP HOLDINGS, INC., Toronto (CA)

( * ) Notice: Subject to any disclaimer, the term of this patent is extended or adjusted under 35 U.S.C. 154(b) by 13 days.

(21) Appl. No.: 18/615,324

(22) Filed: Mar. 25, 2024

(51) Int. Cl.

| | |
|---|---|
| ***B65D 35/56*** | (2006.01) |
| ***B65D 25/28*** | (2006.01) |
| ***B65D 25/54*** | (2006.01) |
| ***B65D 85/72*** | (2006.01) |

(52) U.S. Cl.
CPC ..... *B65D 35/56* (2013.01); *B65D 25/2811* (2013.01); *B65D 25/2885* (2013.01); *B65D 25/54* (2013.01); *B65D 85/72* (2013.01)

(58) Field of Classification Search
CPC ..... B65D 35/56; B65D 25/2811; B65D 25/2885; B65D 25/54; B65D 85/72; B65D 43/0204; B65D 43/0222; B63D 77/06
See application file for complete search history.

(56) References Cited

U.S. PATENT DOCUMENTS 6,574,985 B2 * 6/2003 Fiore, Jr. ..... A45F 3/18 62/457.4
9,085,398 B1 * 7/2015 Fellin ..... B65D 25/04
9,907,420 B2 * 3/2018 Fellin ..... B65D 77/06
11,465,821 B1 * 10/2022 Boomsma ..... B65D 47/06
11,759,035 B2 * 9/2023 Aldous ..... B65D 25/2885 222/212

OTHER PUBLICATIONS

Amazon, "Toddlers Food Pouch Holder, Anti Squeeze Pouch Holder for Food Pouches (Blue)", accessible via website https://www.amazon.com/Toddlers-Pouch-Holder-Squeeze-Pouches/dp/BOCCVV6VRR/, accessed on Jan. 19, 2024, 6 pages.

(Continued)

*Primary Examiner* — Anita M King
(74) *Attorney, Agent, or Firm* — MCANDREWS HELD & MALLOY, LTD

(57) ABSTRACT

According to embodiments, a holder for holding a packaged food item is provided, wherein the packaged food item includes an outlet, the holder including: a housing having an interior region to house the packaged food item, wherein the housing includes an upper portion having an aperture, wherein the housing opens to receive the packaged food item; and an adjustable shelf coupled with the housing, the adjustable shelf is configured to have an adjustable elevation adjustable to a first and a second elevation, the adjustable shelf is a resting portion for the packaged food item, and when the adjustable shelf is at the first elevation, the packaged food item extends through the aperture such that the outlet is at a predetermined area exterior to the housing, and when the adjustable shelf is at the second elevation, the outlet of the packaged food item is not at the predetermined area.

20 Claims, 11 Drawing Sheets

(56) References Cited

OTHER PUBLICATIONS

Amazon, "EasyPouch Independence—The No Squeeze, No Mess, self feeding utensil for baby food pouches. [2 Pack] Model: 852571005003 (Home & Kitchen)", accessible via website https://www.amazon.com/EasyPouch-Independence-Squeeze-feeding-pouches/dp/B00F8NKKZO/, accessed on Jan. 19, 2024, 7 pages.
Amazon, "Fiarfiar Holder Food Pouch Holder Squeeze Proof Refillable Holder for Most Baby Food Squeeze Pouches Baby Supplies Baby Food Pouch Holder", accessible via website https://www.amazon.com/Fiarfiar-Squeeze-Refillable-Pouches-Supplies/dp/B0CF9TY85S, accessed on Jan. 19, 2024, 5 pages.
Amazon, "Squeeze Proof Holder for Food Pouches & Juice Boxes, Universal Multipurpose Design, Makes Baby More Fond of Self-Feeding, Prevent Messes, Food Safe (Purple)", accessible via website https://www.amazon.com/Squeeze-Pouches-Universal-Multipurpose-Self-Feeding/dp/BOCHYQF5ZM/, accessed on Jan. 19, 2024, 7 pages.

* cited by examiner

HOLDER FOR PACKAGED FOOD

CROSS REFERENCE TO RELATED APPLICATIONS

Not applicable

BACKGROUND

Generally, this application relates to holders for packaged food, such food pouches (e.g., squeeze pouches used by toddlers) or juice boxes. As used herein, "packaged food" or "packaged food item" includes packaged beverages for the sake of clarity and simplicity. Similarly, as used herein, "food" includes both food and beverages. In particular, this application relates to holders that allow a person to insert or remove a packaged food item into/from a holder, while allowing a user (e.g., toddler) to consume the food through the holder.

SUMMARY

According to embodiments, a holder for holding at least one type of packaged food item that packages food is provided, wherein the at least one type of packaged food item includes an outlet through which the food is accessed, the holder comprising: a housing including an interior region in which to house one of the at least one type of packaged food item, wherein the housing includes an upper portion having at least one aperture, wherein the housing is configured to open to receive the one of the at least one type of packaged food item; and an adjustable shelf coupled with the housing, wherein the adjustable shelf is configured to have an adjustable elevation adjustable to a first elevation and a second elevation, wherein the adjustable shelf is configured to be a resting portion for the one of the at least one type of packaged food item, and wherein when the adjustable shelf is at the first elevation, the at least one type of packaged food item extends through the aperture in the upper portion of the housing such that the outlet is at a predetermined area exterior to the housing, and wherein when the adjustable shelf is at the second elevation, the outlet of the one of the at least one type of packaged food item is not at the predetermined area. The aperture is at a third elevation and a distance between the first elevation and the third elevation may be between approximately 5.22-5.42 inches. A width of the aperture may be between approximately 0.44-0.64 inches. The housing may include at least one first receiving feature to receive the adjustable shelf and at least one second receiving feature to receive the adjustable shelf, wherein the at least one first receiving feature is above the at least one second receiving feature. When the adjustable shelf is received by the at least one first receiving feature, the adjustable shelf may be adjustable into a plurality of elevations. The at least one first receiving feature may include a plurality of slots, and wherein the at least one second receiving feature comprises a plurality of slots. The adjustable shelf may include at least one insertion feature and a resting portion upon which the one of the at least one type of packaged food item is configured to rest, wherein the at least one insertion feature is selectively receivable by the at least one first receiving feature and by the at least one second receiving feature, and wherein the resting portion of the adjustable shelf has a different elevation than the at least one insertion feature. The housing may include a lower portion, wherein the adjustable shelf is removable from the interior region of the housing, and wherein when the adjustable shelf is removed from the interior region of the housing, the interior region of the housing is configured to receive the one of the at least one type of packaged food item such that the one of the at least one type of packaged food item rests on the lower portion of the housing. The housing may include a front portion including a hinge portion in a lower region of the front portion, and wherein the front portion is hingedly coupled to another portion of the housing, such that the front portion rotates downwardly to allow placement of the one of the at least one type of packaged food item into the interior region of the housing. The housing may include at least one spring configured to selectively secure the front portion of the housing to another portion of the housing to form the interior region of the housing.

According to embodiments holder is provided for holding at least one type of packaged food item for food, wherein the at least one type of packaged food item includes an outlet through which the food is accessed, the holder comprising: a housing including: a first portion including an upper portion, a lower portion, a at least one receiving feature, and at least one hinge feature, wherein the upper portion comprises a recess, wherein the recess is configured to receive a nozzle of one of the at least one type of packaged food item; and a second portion including at least one hinge feature coupled with the at least one hinge feature of the first portion to form a hinge, such that the second portion is rotatable with respect to the first portion; and a removable shelf including a resting portion and at least one insertion feature, wherein the at least one insertion feature is configured to be received by the at least one receiving feature. The resting portion of the removable shelf may be at a different elevation than the at least one insertion feature of the removable shelf when the at least one insertion feature is received by the at least one receiving feature of the first portion of the housing. The first portion of the housing may include a second at least one receiving feature, and wherein the at least one insertion feature of the removable shelf is configured to be received by the second at least one receiving feature of the first portion of the housing. The first portion of the housing may include a second at least one receiving feature, and wherein the at least one insertion feature of the removable shelf is configured to be received by the second at least one receiving feature of the first portion of the housing. The first portion of the housing may include an opaque material, and the second portion of the housing comprises at least one of a transparent material or a translucent material. Each of the at least one hinge feature of the second portion of the housing may be located in a lower region of the second portion of the housing. The recess in the upper portion of the first portion of the housing may have a width between approximately 0.44-0.64 inches. A distance between the upper portion and lower portion of the housing may be between approximately 5.45-5.65 inches. The housing may include at least one spring configured to selectively secure the first portion of the housing to the second portion of the housing. The at least one spring may be located on the second portion of the housing.

Figure 1:
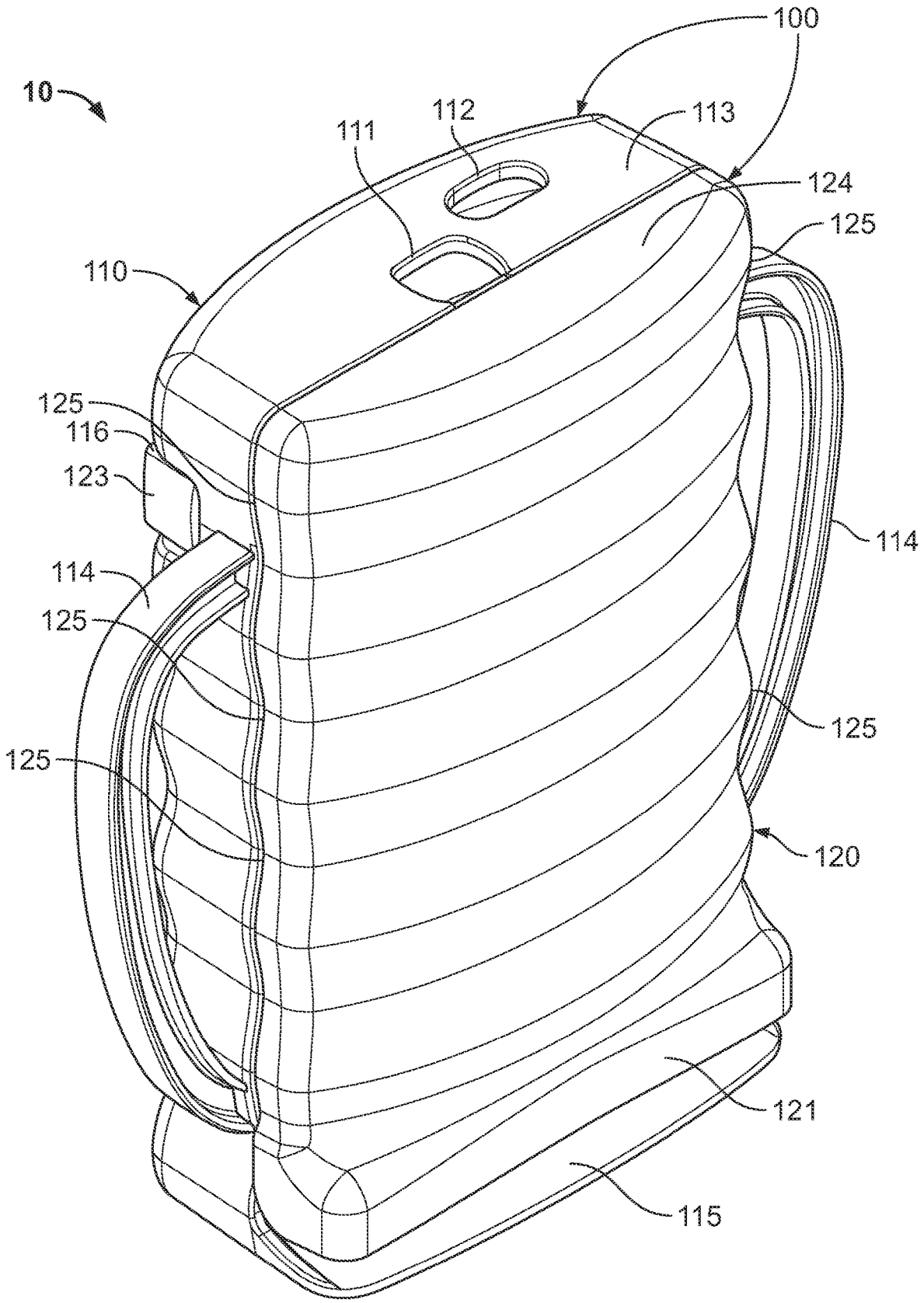
FIG. 1 illustrates a front, top perspective view of a holder, according to embodiments.
Figure 2:
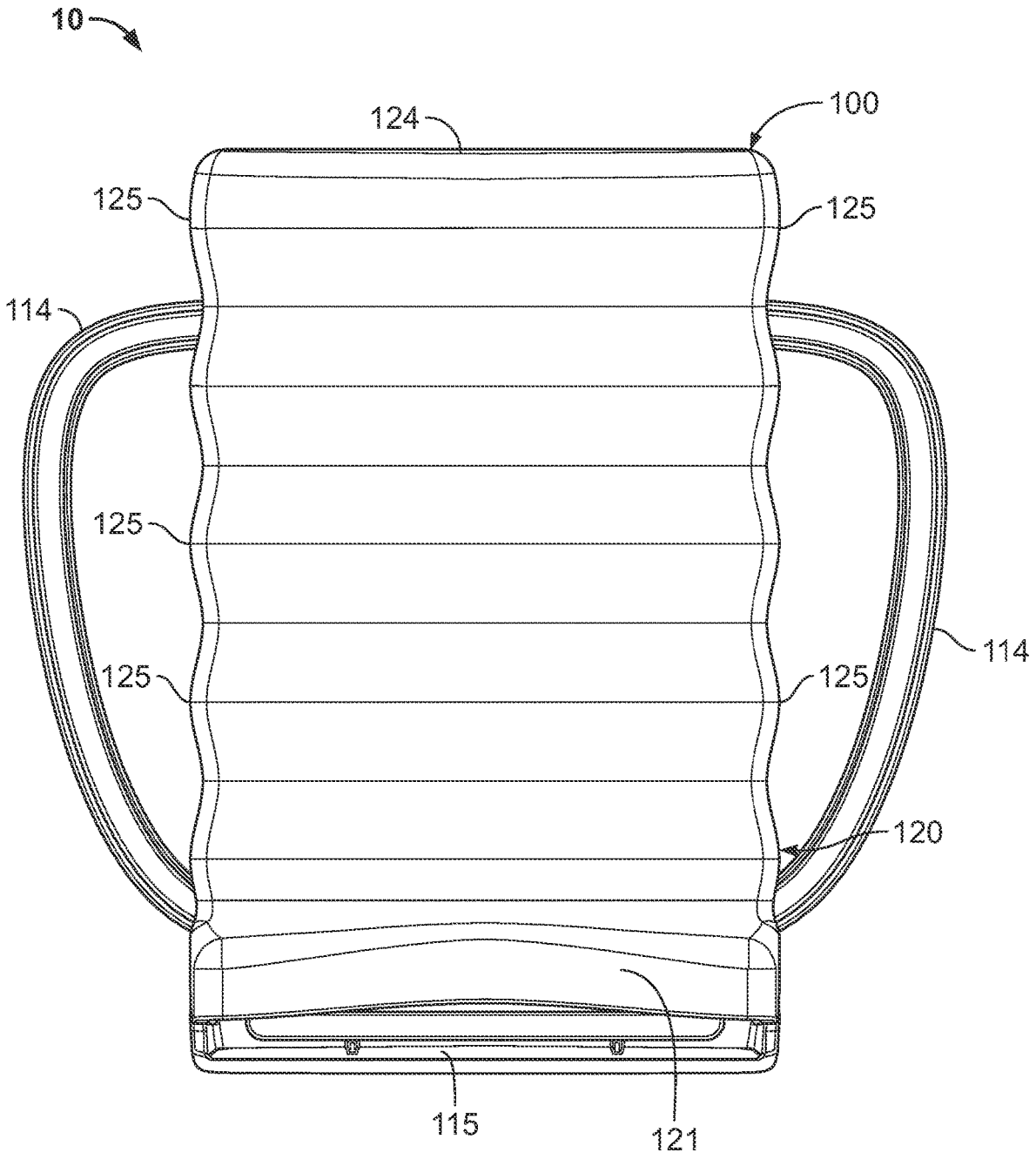
FIG. 2 illustrates a front elevation view of a holder, according to embodiments.
Figure 3:
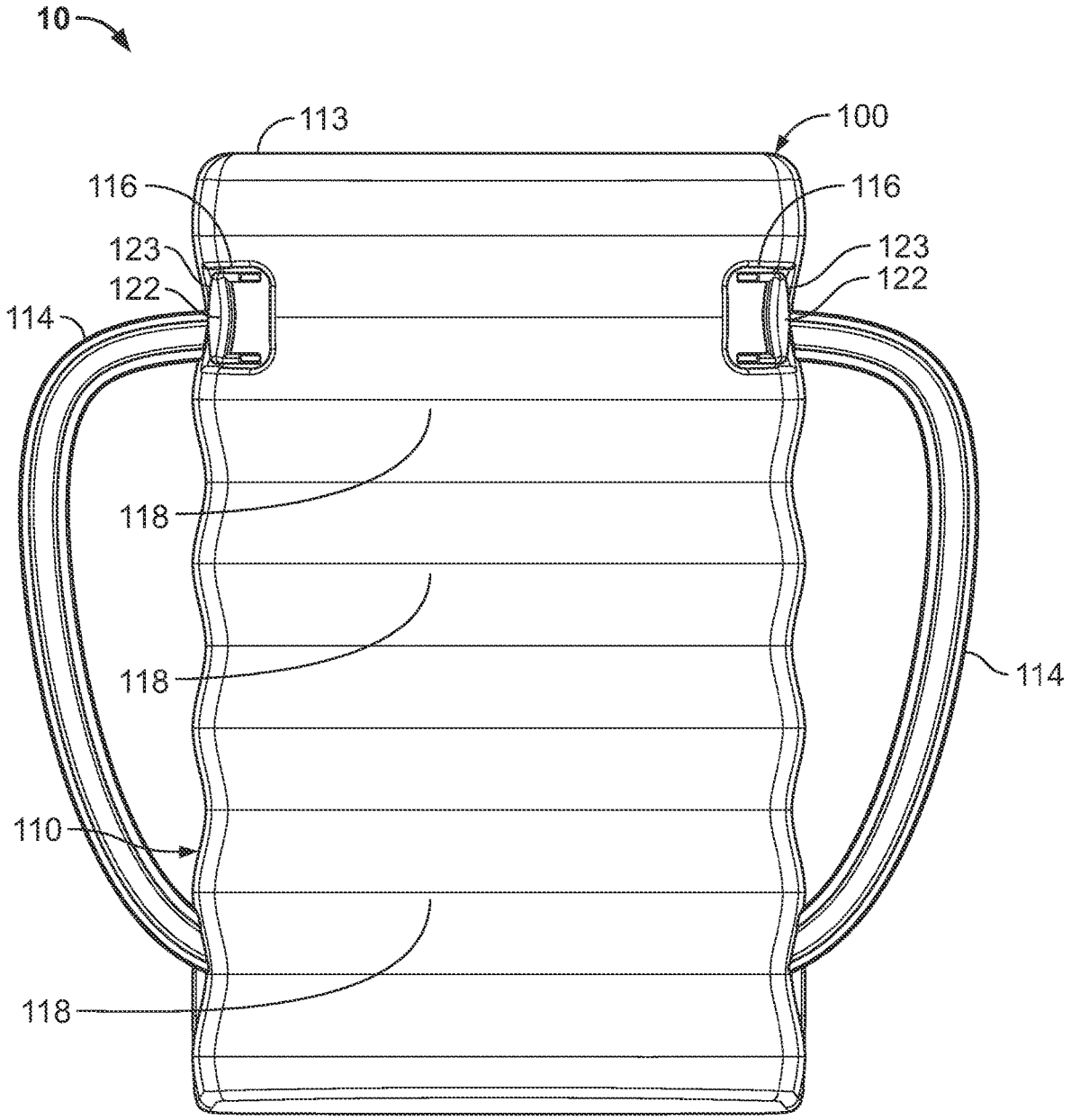
FIG. 3 illustrates a rear elevation view of a holder, according to embodiments.
Figure 4:
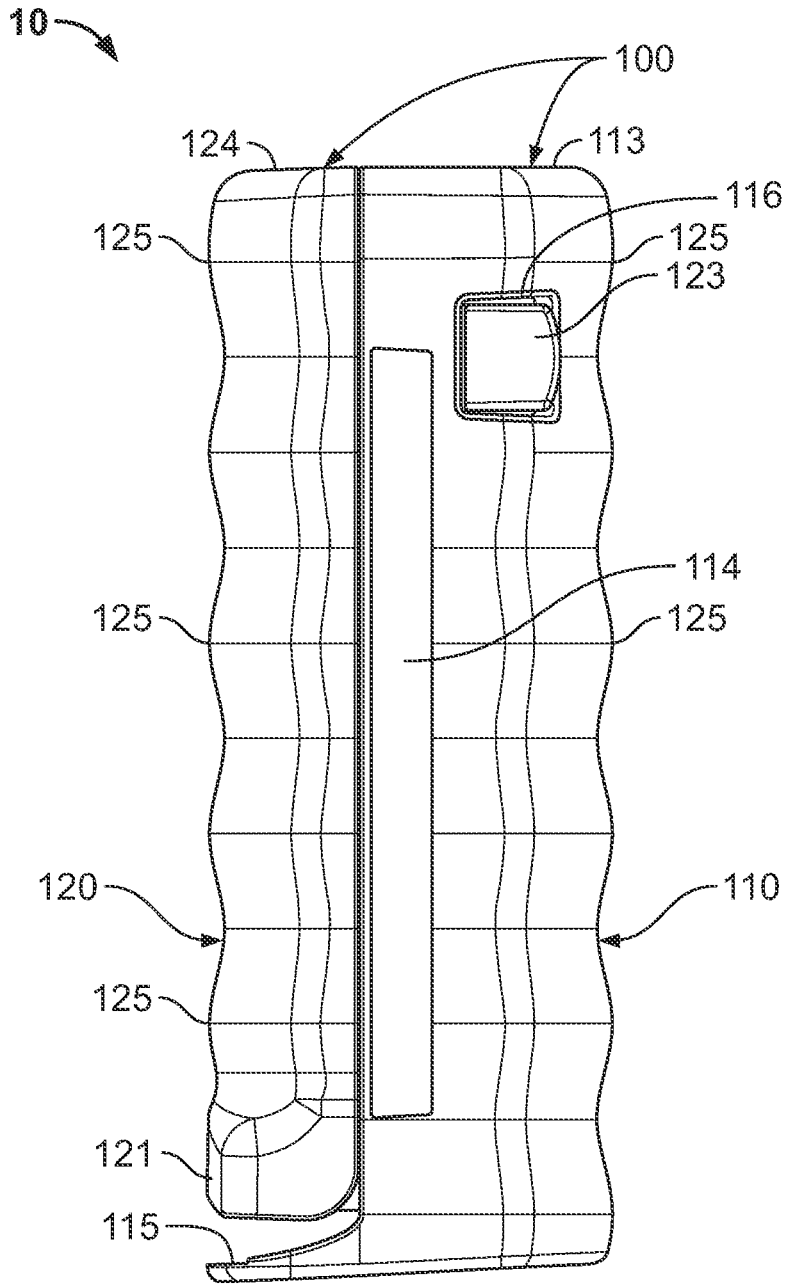
FIG. 4 illustrates a right-side elevation view of a holder, according to embodiments.
Figure 5:
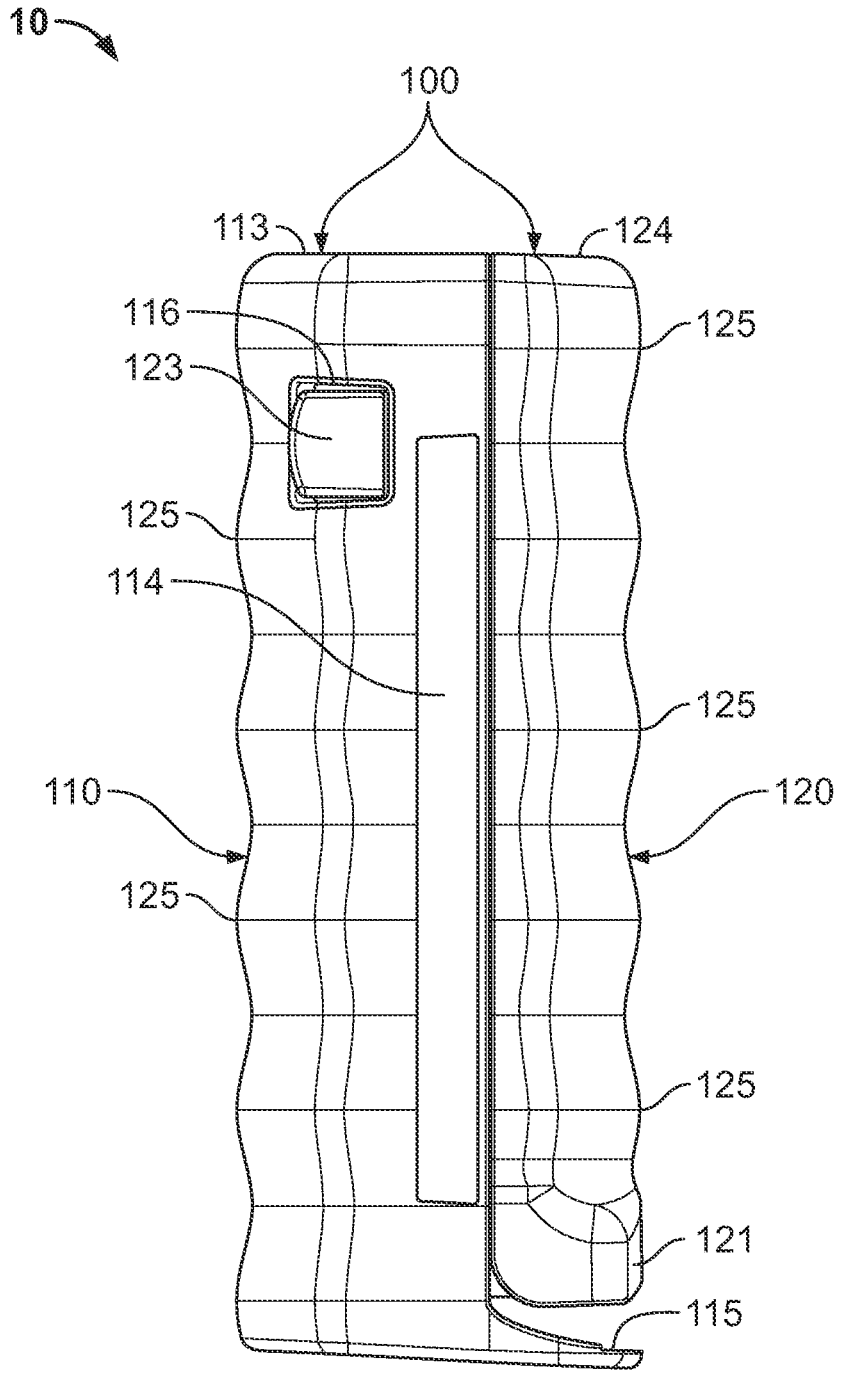
FIG. 5 illustrates a left-side elevation view of a holder, according to embodiments.
Figure 6:
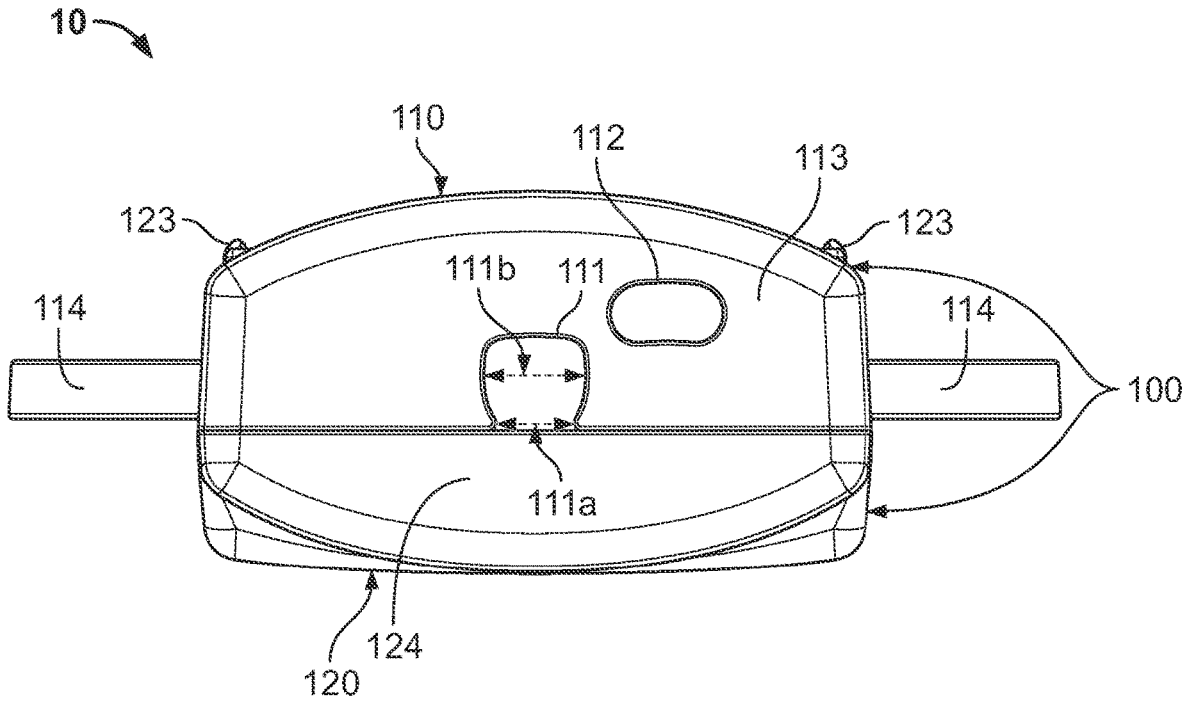
FIG. 6 illustrates a top plan view of a holder, according to embodiments.
Figure 7:
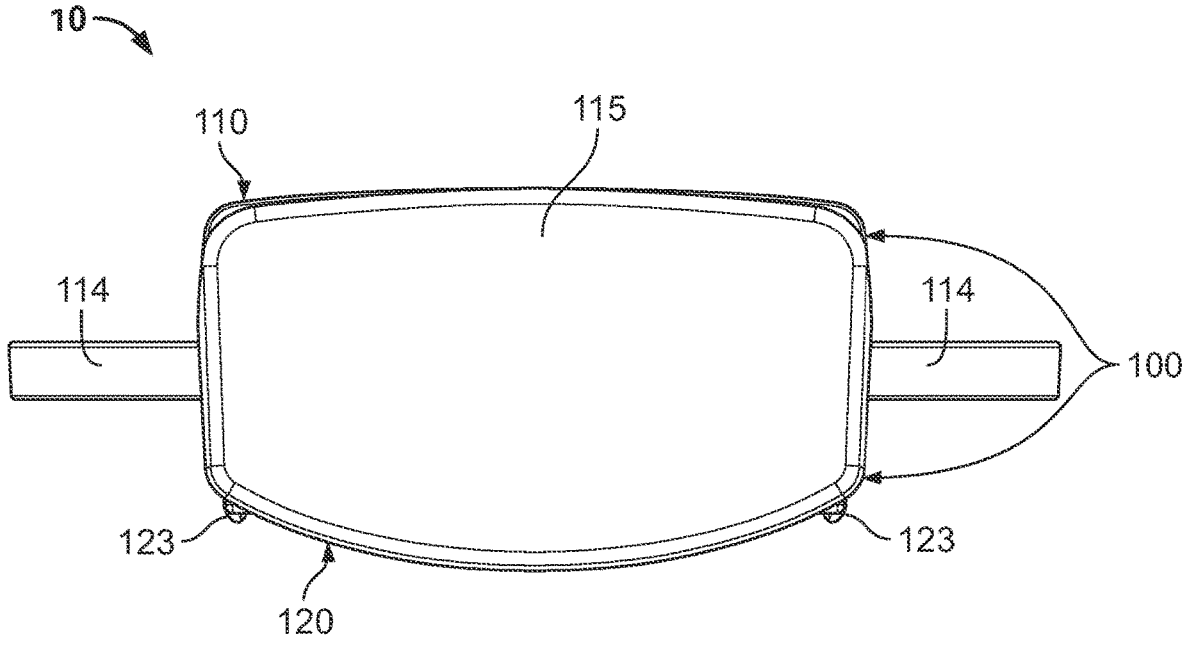
FIG. 7 illustrates a bottom plan view of a holder, according to embodiments.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

Users or consumers of packaged food may be young children, such as toddlers. Many such packaged food items are packaged in relatively flexible packages. Such packages may include an outlet for the food, such as a nozzle (in the case of a type of food pouch) or a hole or straw (in the case of a type of juice box). The user of a packaged food item may suck the food through the outlet. Also, compression of the packaged food item (e.g., squeezing a food pouch) may cause the food to exit through the outlet. Such compression may be caused by the user (e.g., a zealous toddler squeezing) or by engagement with foreign objects (e.g., the toddler sitting on the packaged food). Such compression may be undesirable, for example, because such compression may cause the food to go in a location other than the user's mouth, such as on furniture, car seats, clothing, or the like. As such misplaced food should be cleaned up, it may be desirable to reduce the risk of food misplacement.

Further, packaged food items come in various forms and sizes, and package various foods. Some packaged food items may be taller than others. Some packaged food items may have different types of outlets, such as nozzles or straws. A user may consume food from such different packaged food items, and similar problems discussed above may arise for such different packaged food items.

To solve the aforementioned and other problems, various embodiments of holder(s) are disclosed herein, inclusive of the accompanying figures and other documents filed in the instant application. An exemplary holder may substantially house differently-sized packaged food items at different times. An exemplary holder may include an adjustable shelf with an adjustable elevation to accommodate packaged food items having different heights and outlets. An exemplary holder may be openable (e.g., with a hinged-design) such that a packaged food item can be conveniently inserted or removed.

FIGS. 1-11 illustrate different views of embodiments of a holder 10, as described above. The holder 10 is configured to hold one or more packaged food items 2, 4 (see FIGS. 10 and 11). Exemplary packaged food items include a juice box 2 and a squeeze pouch 4. A juice box 2 may include a box and an outlet, such as a straw, which may be configured to punch through a straw hole on the juice box 2 (e.g., a hole on the top of the juice box 2). A consumer may suck fluid contained in the box through the straw. A squeeze pouch 4 may include a pouch, which contains the food, and an outlet, such as a nozzle. A consumer may suck the food from the pouch through the nozzle of the squeeze pouch 4. The nozzle may include a shaft with recesses. The shaft may include one or more recess(es) on the outer surface. The recess(es) may be cylindrical. As will be further explained, such a recess may be received by or engage with the holder 10.

The holder 10 includes a housing 100. The housing 100 has an interior region in which to house the packaged food items 2, 4. The housing 100 may include a rear portion 110 and a front portion 120. The rear portion 110 and the front portion 120 may be attached such that one can rotate with respect to the other. The rear portion 110 and the front portion 120 may be attached by a hinge. One example of a hinge is a clamshell hinge coupled with each of the rear portion 110 and the front portion 120. Another example of a hinge is one with hinge portions, such as the depicted hinge. The rear portion 110 and the front portion 120 may each have mating hinge portions. One of the rear portion 110 or front portion 120 may have protrusion(s) and the other may have recess(es). The protrusion(s) may mate with or snap into the recess(es) such that the front portion 120 may rotate with respect to the rear portion 110. The hinge portions may be in lower regions of the rear portion 110 and the front portion 120. The front portion 120 may rotate upwardly/downwardly as shown, for example in FIG. 8 such that the operator may access the interior region of the housing to insert or remove the packaged food item 2, 4. In the embodiments of FIG. 9, the rear portion 110 includes a pair of cylindrical protrusions. Such protrusions may mate with corresponding cylindrical recesses on the front portion 120 (recesses not shown).

The rear portion 110 may include an upper portion 113. The upper portion 113 forms at least a portion of the upper portion of the housing 100. When the rear portion 110 and the front portion 120 are secured with each other, the upper portion of the housing 100 may be extended by the upper portion 124 of the front portion 120. The upper portion 113 may include a recess 111 having a width 111*b* and another narrower width 111*b* proximate an edge of the rear portion 110 or an outer end of the recess 111. The rear portion 110 may further have an aperture 112 (or a recess) to accommodate outlet(s) of the packaged food item(s) 2, 4. The rear portion 110 may further include one or more handles 114, a lower portion 115, one or more apertures 116 (or recesses), one or more receiving features 117, or one or more ridges 118. The entirety or only some of the rear portion 110 may be transparent (including translucent) or opaque. In the case of the rear portion 110 being transparent (in whole or in part), it is possible to view the packaged food items 2, 4 through the rear portion 110 and optionally be able to read words printed on the exterior of the packaged food items 2, 4 contained within the housing 100. The rear portion 110 may be substantially rigid such that squeezing of the consumer's hand or an impact with a foreign object that is not undue will not cause the rear portion 110 to exert a substantial force against the packaged food item 2, 4 to cause inadvertent flow of food through the outlet of the packaged food item 2, 4.

The recess 111 of the rear portion 110 may accommodate or receive an outlet of the packaged food item 2, 4. For example, the recess 111 may be sized to receive a nozzle of a squeeze pouch 4. The recess 111 may have a width 111*b*, which may be wide enough to receive an outlet of a packaged food item 2, 4 without compressing or deflecting the outlet (e.g., nozzle of the squeeze pouch 4) inwardly. In the case of a nozzle of a squeeze pouch 4, the width 111*b* may be wide enough to accommodate a recess in the shaft of the nozzle. The width 111*b* may also be narrower than the non-recessed portions proximate the recess. This may inhibit vertical movement of the nozzle, as the non-recessed portions of the nozzle may interfere with the upper portion 113 of the front portion 110. Such a width 111*b* may be between approximately 0.44-0.64 inches, such as approximately 0.54 inches. Further, the depth of the recess 111 (e.g. thickness of the upper portion 113 at or proximate the edge of the recess 111 may correspond to a height of a recess in the shaft of the packaged food item (e.g., packaged food item 4). Such a depth of the recess 111 may not be deeper than a given recess in the shaft of the packaged food item (e.g., packaged food item 4).

The recess 111 may have a narrower width 111*a* proximate an outer region of the recess 111. The width 111*a* may be narrower than the width 111*b*. The width 111*a* may be narrower than the outer diameter of the recessed region of the nozzle of the squeeze pouch. The width 111*a* may be between approximately 0.33-0.53 inches, such as approximately 0.43 inches. The length of the recess 111 may be between approximately 0.41-0.61 inches, such as approximately 0.51 inches. When inserting the nozzle of the squeeze pouch 4 into the recess 111, the upper portion 113 at the region(s) of the width 111*a* may compress or deflect the nozzle (e.g., the recessed region). Optionally, the nozzle (e.g., at the recessed region) may deflect the upper portion 113 region(s) of the width 111*a*. With such an arrangement of a narrower width 111*a*, the squeeze pouch 4 nozzle may snap into the recess 111 when being inserted in a substantially horizontal direction. The upper portion 113 may then horizontally constrain the nozzle of the squeeze pouch 4 from horizontal movement unless a stronger force is exerted to snap the nozzle out of the recess 111. The edge(s) of the upper portion 113 at the width 111*a* may have curvature(s) or other feature(s) (e.g., triangular edge(s)) to promote snapping the nozzle or outlet in and out of the recess 111. The recess 111 may become an aperture when the rear portion 110 is secured to the front portion 120, as an edge of the upper portion 124 of the front portion 120 may transverse the open side of the recess 111. The edge of the upper portion 124 of the front portion 120 may further ensure that the nozzle or outlet is constrained in the horizontal direction. Further, portions of the non-recessed regions of the shaft of the nozzle may interfere with the upper portion 124 of the front portion 120 to further constrain vertical movement of the packaged food item (e.g., packaged food item 4) by constraining vertical movement of the nozzle or outlet.

The upper portion 113 of the rear portion 110 may include an aperture 112, which may receive an outlet of a packaged food item (e.g., straw of juice box 2). The aperture 112 may not be configured to receive or accommodate the outlet of a packaged food item (e.g., nozzle of squeeze pouch 4). The aperture 112 may have a narrower width and/or no horizontal opening that may prevent insertion of such an outlet. Optionally, the aperture 112 may be substantially offset from the center of the upper portion 113 (e.g., center of the width of the upper portion 113) to prevent or discourage insertion of the outlet that can be received by recess 111.

The rear portion 110 may further include one or more handles 114. The handle(s) 114 may be coupled (e.g., integrated) with lateral sides of the rear portion 110. The handle(s) may be C-shaped to receive fingers of the consumer. The rear portion 110 may further include ridges 118 (e.g., horizontal ridges) on the lateral and/or rear surface(s) of the rear portion 110. The ridges 118, when horizontal, may wrap around the lateral and rear surfaces. The ridges 118 may have a curved or rounded profile.

The front portion 120 may have a lower region 121, a spring including for example a spring arm 122 and optionally a spring arm head 123, an upper portion 124, ridges 125, or one or more constraining portions 126. The entirety or only some of the front portion 120 may be transparent (including translucent) or opaque. According to one embodiment, the front portion 120 is transparent and the rear portion 110 is opaque. In the case of the front portion 120 being transparent (in whole or in part), it is possible to view the packaged food items 2, 4 through the front portion 120 and optionally be able to read words printed on the exterior of the packaged food items 2, 4 contained within the housing 100. The front portion 120 may be substantially rigid such that squeezing of the consumer's hand or an impact with a foreign object that is not undue will not cause the front portion 120 to exert a substantial force against the packaged food item 2, 4 to cause inadvertent flow of food through the outlet of the packaged food item 2, 4.

The rear portion 110 and the front portion 120 may selectively engage and disengage with each other to close and open the housing 100, respectively. When engaged, the rear portion 110 and the front portion 120 may be secured together, requiring specific user intervention to open the housing 100. According to embodiments, disengagement of the rear portion 110 from the front portion 120 may require at least two fingers of an operator—e.g., a thumb and another finger on a single hand, or fingers on separate hands. The distance between the fingers required for disengagement may be between approximately 3.1-3.5 inches, such as approximately 3.3 inches. According to such a design, a child (e.g., toddler) may not be able to disengage the rear portion 110 from the front portion 120 with a single hand, while an adult may be able to cause disengagement.

Selective engagement and disengagement of the rear portion 110 and the front portion 120 may be effected in the following manner. At a region (e.g., lower region) of the rear portion 110 and a region (e.g., lower region) of the front portion 120 the rear portion 110 and front portion 120 may be secured (e.g., by a hinge or portion(s) of a hinge). The front portion 120 may be able to rotate around the hinge. When the front portion 120 rotates or moves towards the rear portion 110, they may be selectively engagable with each other. In the embodiments depicted, the rear portion 110 includes apertures 116, although it may be possible to have only one aperture 116. A given aperture 116 is shown as wrapping around the rear region and lateral region of the rear portion 110, although it may be possible to have the given aperture 116 only in the rear region or a lateral region of the rear portion 110. A given aperture 116 may be sized to receive a human finger, or a tip thereof. In a corresponding region of the front portion 120, there may be corresponding spring(s) (two are shown). A given spring may include a spring arm 122 and a spring arm head 123. A given spring (e.g., spring arm 122) may extend rearwardly from the front portion 120, e.g., in an upper region of the front portion 120.

In the embodiments depicted, a given spring arm 122 can rotate in a horizontal dimension into a compressed state (e.g., rotating inwardly as shown) and a decompressed (e.g., substantially or completely decompressed) state (e.g., as depicted, extending horizontally from the front portion 120 towards the rear portion 110).

In the illustrated embodiments, when the rear portion 110 and the front portion 120 are selectively engaged, a given spring arm 122 is in a decompressed state, the spring arm head 123 extends at least partially into or through a corresponding aperture 116. The spring arm head 123 may be shaped such that it will not readily be forced completely out of the aperture 116. For example, a forward-facing surface of the spring arm head 123 may be substantially flat and substantially vertically-oriented, and a corresponding rearward-facing surface of the aperture 116 may also be flat and substantially vertically-oriented to match the forward facing surface of the spring arm head 123. Optionally, these surfaces may have complementary mating profiles (e.g., one is the inverse of the other) that discourage the spring arm head 123 from exiting the aperture 116 when the front portion 120 and/or rear portion 110 experience forces that would otherwise tend to cause separation.

To effect disengagement, a force may be applied to the spring arm head 123 through the aperture 116. For example, a human finger may force the spring arm head 123 to exit the aperture 116 into the interior region of the housing 100. This may cause the spring or spring arm 122 to compress. Once the spring arm head(s) 123 are in the interior of the housing 100 and out of the aperture 116, the front portion 120 may be moveable (e.g., rotatable) with respect to the rear portion 110. For example, the front portion 120 may then be rotatable (e.g., in a downward direction) with respect to the rear portion 110 about the hinge. Once the housing 100 is opened, a user may insert or remove the packaged food item 2, 4. In the case of an outlet of a packaged food item (e.g., nozzle of the squeeze pouch 4) being snapped into the recess 111 in the upper portion 113 of the rear portion 110, a removal force may need to be applied to the nozzle itself to snap the nozzle out of the recess 111. Similarly, an insertion force may need to be applied to the nozzle or outlet of the packaged food item (e.g., packaged food item 4), or to another portion of the packaged food item, such as a region below but proximate to the nozzle, to snap the outlet into the recess 111.

In the case of two spring arm heads 123 and two corresponding apertures 116, each spring arm head 123 may include a lateral surface that, when the front portion 120 and the rear portion 110 are engaged with each other, each spring arm head 123 exposed via the corresponding aperture 116. In this state, the lateral surfaces of the two spring arm heads 123 may face outwardly in opposite directions. The lateral surfaces of the two spring arm heads 123 may be spaced apart from each other by between approximately 3.1-3.5 inches, such as 3.3 inches. Each spring arm head 123 may be forced inwardly at the same time to remove each spring arm head 123 from the corresponding aperture 116. At this time, the front portion 120 may be moved with respect to the rear portion 110. Such a design may enable an adult using a single hand, where that hand is relatively large and strong, to disengage the front portion 120 from the rear portion 110, while inhibiting a child with a smaller, weaker hand from doing the same.

To close the housing 100, the spring on the front portion 120 is moved towards the rear portion 110. The spring may be in a decompressed state before it engages with the front portion. The spring arm head 123 may deflect inwardly, thereby causing the spring arm 122 to deflect inwardly and move into a compressed state. The spring arm head 123 may have a profile (e.g., rounded and/or slanted profile) that facilitates deflection of the spring when the front portion 120 and the rear portion 110 are forced together. As the front portion 120 and the rear portion 110 are further brought together, the entirety of the spring arm head 123 may move into a region where the spring arm head 123 is completely exposed through the aperture 116. At such a time, the spring (e.g., spring arm 122) may decompress (e.g., automatically decompress due to the memory of the spring arm 122), thereby forcing the spring arm head 123 into the aperture 116.

Either the front portion 120 or the rear portion 110 may include a rotation-limiting feature that prevents over-rotation of the front portion 120 with respect to the rear portion 110. As shown, the front portion 120 includes a lip in the lower region 121. As the front portion 120 rotates downwardly, this lip contacts the lower portion 115 of the rear portion 110, thereby preventing further rotation.

Figure 8:
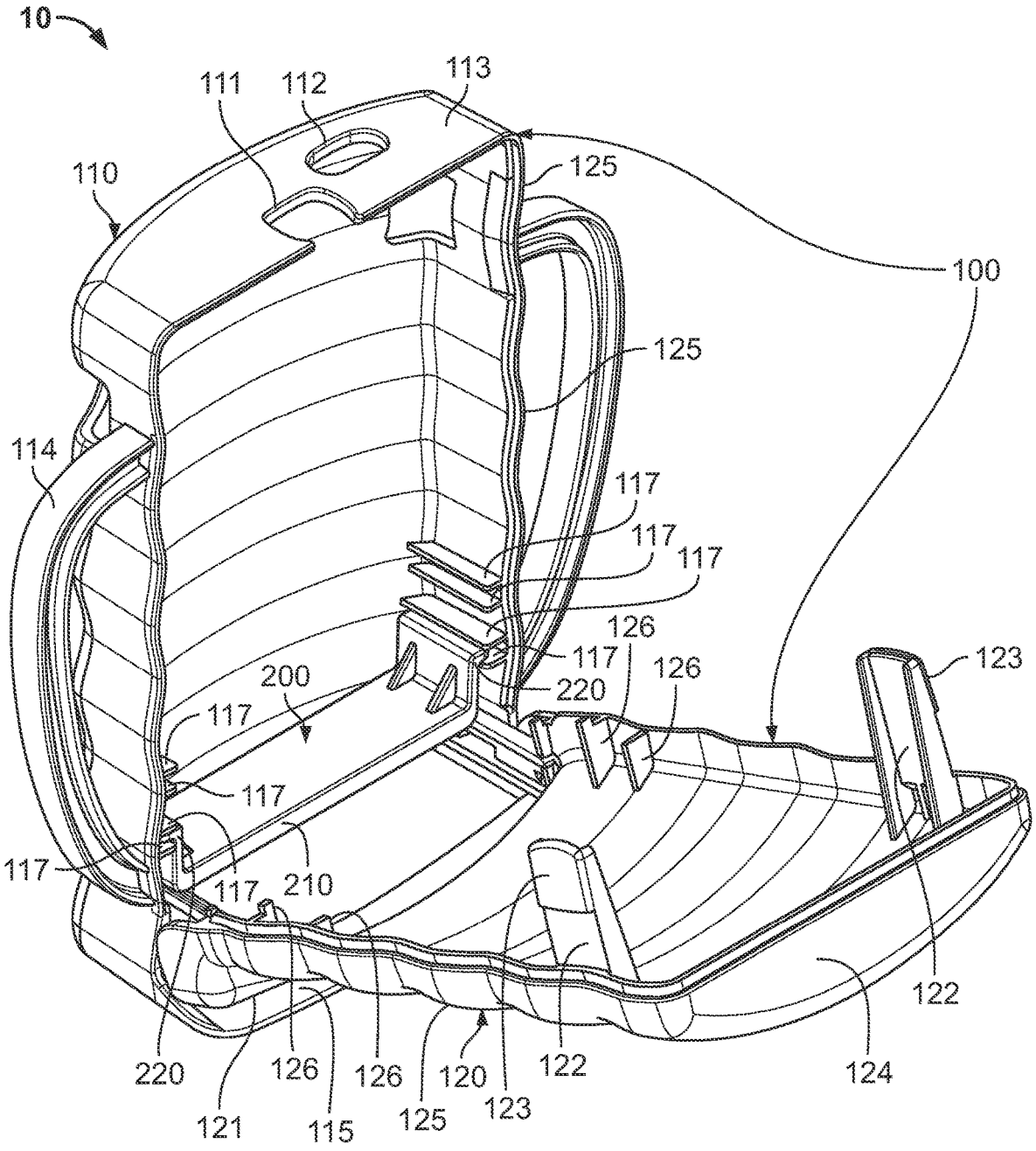
FIG. 8 illustrates a front, top perspective view of a holder in an open position, according to embodiments.
Figure 9:
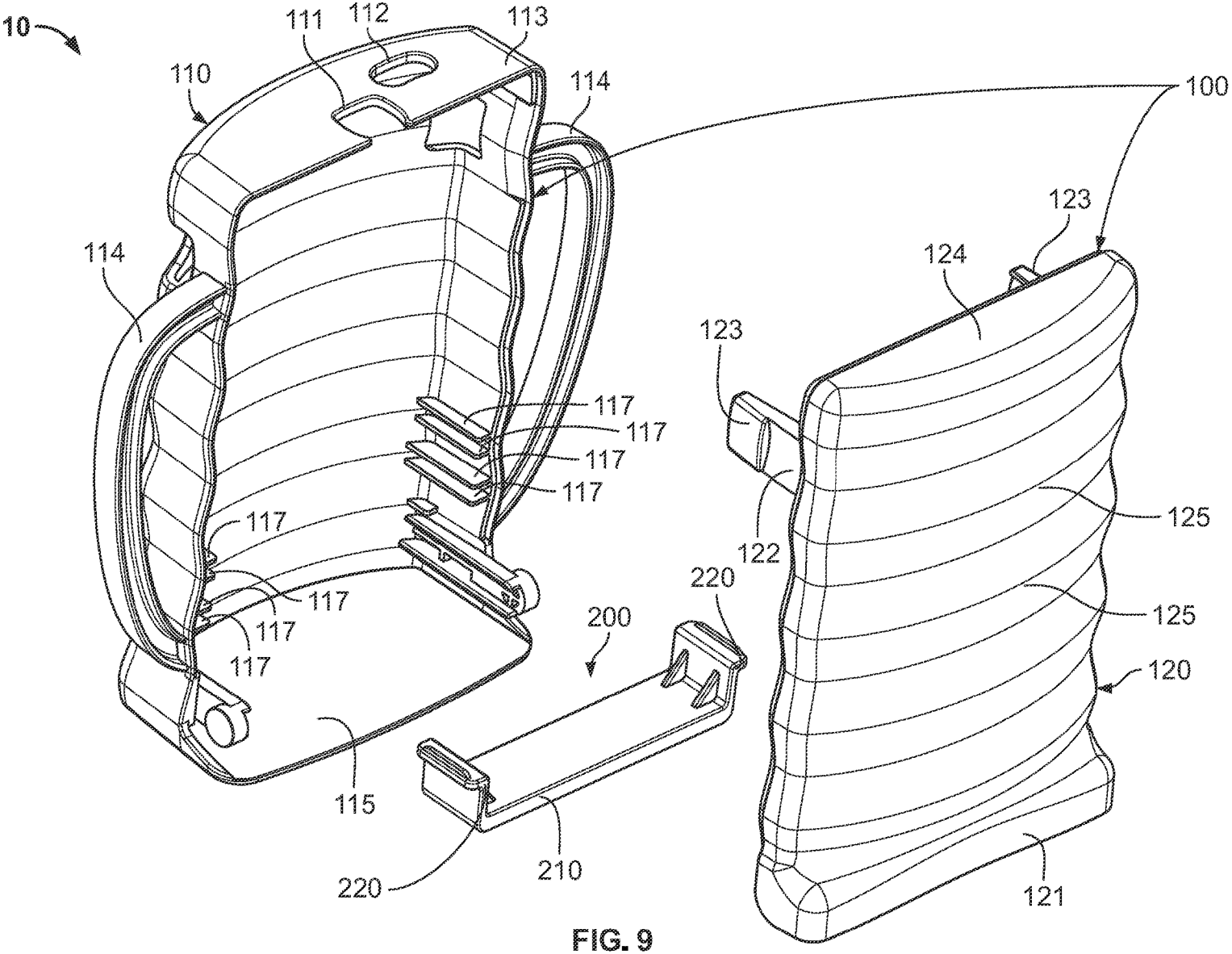
FIG. 9 illustrates an exploded perspective view of a holder, according to embodiments.

The holder 10 may further include an shelf 200 (e.g., an adjustable shelf 200, see FIGS. 8 and 9). The shelf 200 may have an adjustable elevation, when measured with respect to the upper portion (in the depicted embodiments, 113, 124) or lower portion (in the depicted embodiments, lower portion 115) of the housing 100.

The shelf 200 may selectively couple with the housing 100. The shelf 200 may include a resting portion 210 and an insertion feature 220. The depicted shelf 200 shows two insertion features 220, each positioned laterally with respect to the resting portion 210. The shelf 200 may have a "hat" shape, in which the resting portion 210 is at a different elevation from at least one of the insertion feature(s) 220.

The shelf 200 may be adjustable. For example, the shelf 200 may couple with the housing 100 in different orientations. In one orientation, the resting portion 210 may be at a lower elevation than at least one of the insertion feature(s) 220 (hereinafter, "first orientation," for exemplary purposes). In another orientation, the shelf may be flipped vertically, such that the resting portion 210 is at a higher elevation than at least one of the insertion feature(s) 220 (hereinafter, "second orientation," for exemplary purposes).

The shelf 200 may further be adjustable according to embodiments in which the shelf 200 couples to the housing 100 via the insertion feature(s) 220, where the insertion feature(s) 220 are coupled to the housing 100 at different elevations. As shown in, for example, FIGS. 8 and 9, the housing 100 may include a plurality of receiving features 117. The receiving features 117 may be on or part of rear portion 110. In the embodiments depicted, two given receiving features 117 are spaced to form a slot. The slot is sized to receive a given insertion feature 220. As shown, there may be a total of four slots formed by eight receiving features 117. Two given slots may oppose each other and be located on or proximate the lateral sides of the rear portion 110 within the interior region.

In the depicted embodiments, the shelf 200 may be adjustable into five configurations. In the first configuration, the shelf 200 is in the first orientation and the insertion features 220 are received by the upper pair of opposing slots formed by receiving features 117. The second configuration is similar to the first configuration, except the shelf 200 is in the second orientation. The third configuration (shown in the embodiments in FIGS. 8 and 10) is similar to the first configuration, except the insertion features 220 are received by the lower pair of opposing slots formed by receiving features 117. The fourth configuration is similar to the third configuration, except that the shelf 200 is in the second orientation. In the fifth configuration, the packaged food item (e.g., squeeze pouch 4) may rest on the lower portion 115 off the rear portion 110. In various ones of the configurations, the distance between the resting portion 210 or lower portion 115 and the upper portion of the housing 100 may be between approximately 5.45-5.65 inches, such as approximately 5.55 inches, as may be the case when the packaged food item (e.g., squeeze pouch 4) rests on the lower portion 115. In various ones of the configurations, the distance between the resting portion 210 or lower portion 115 of the rear portion 110 and the upper portion of the housing 100 may be between approximately 5.22-5.42 inches (e.g., approximately 5.32 inches), between approximately 4.67-4.87 inches (e.g., approximately 4.77 inches), and/or between approximately 4.17-4.37 inches (e.g., approximately 4.27 inches).

Once the shelf 200 has been configured with respect to the housing 100, the packaged food item 2, 4 may be inserted into the housing 100. Depending on the configuration, the packaged food item 2, 4 may rest on either the resting portion 210 of the shelf 200 (first, second, third, or fourth configuration, described above) or on the lower portion 115 of the rear portion 110 when, for example, the shelf 200 has been removed from the interior region of the housing 110 (fifth configuration, described above). Once the packaged food item 2, 4 has been inserted, the housing 100 may be closed, as the front portion 120 may be secured to the rear portion 110. Once closed, the shelf 200 may further be secured to the housing 100 with one or more constraining portion(s) 126. In the illustrated embodiments, the constraining portion(s) 126 are located on the front portion 120. The constraining portion(s) 126 may establish a limit to how far the shelf 200 or shelf insertion portion(s) 220 can travel in a forward direction towards the front portion 120. As illustrated, when the front portion 120 is secured to the rear portion 110, the constraining portion(s) 126 may be at elevation(s) and/or horizontally located in region(s) corresponding to given slot(s) formed by the receiving feature(s) 117 where the insertion portion(s) 220 are located or are potentially located.

When the shelf 200 is in a proper configuration to accommodate a packaged food item 2, 4, the outlet, or a particular portion thereof (e.g., the straw hole in a juice box 2 or a given recess in the shaft of the nozzle of a squeeze pouch 4), of the given packaged food item may be at a predetermined area. When the shelf 200 is not in such a proper configuration, the outlet, or the particular portion thereof, may not be in a predetermined area.

Figure 10:
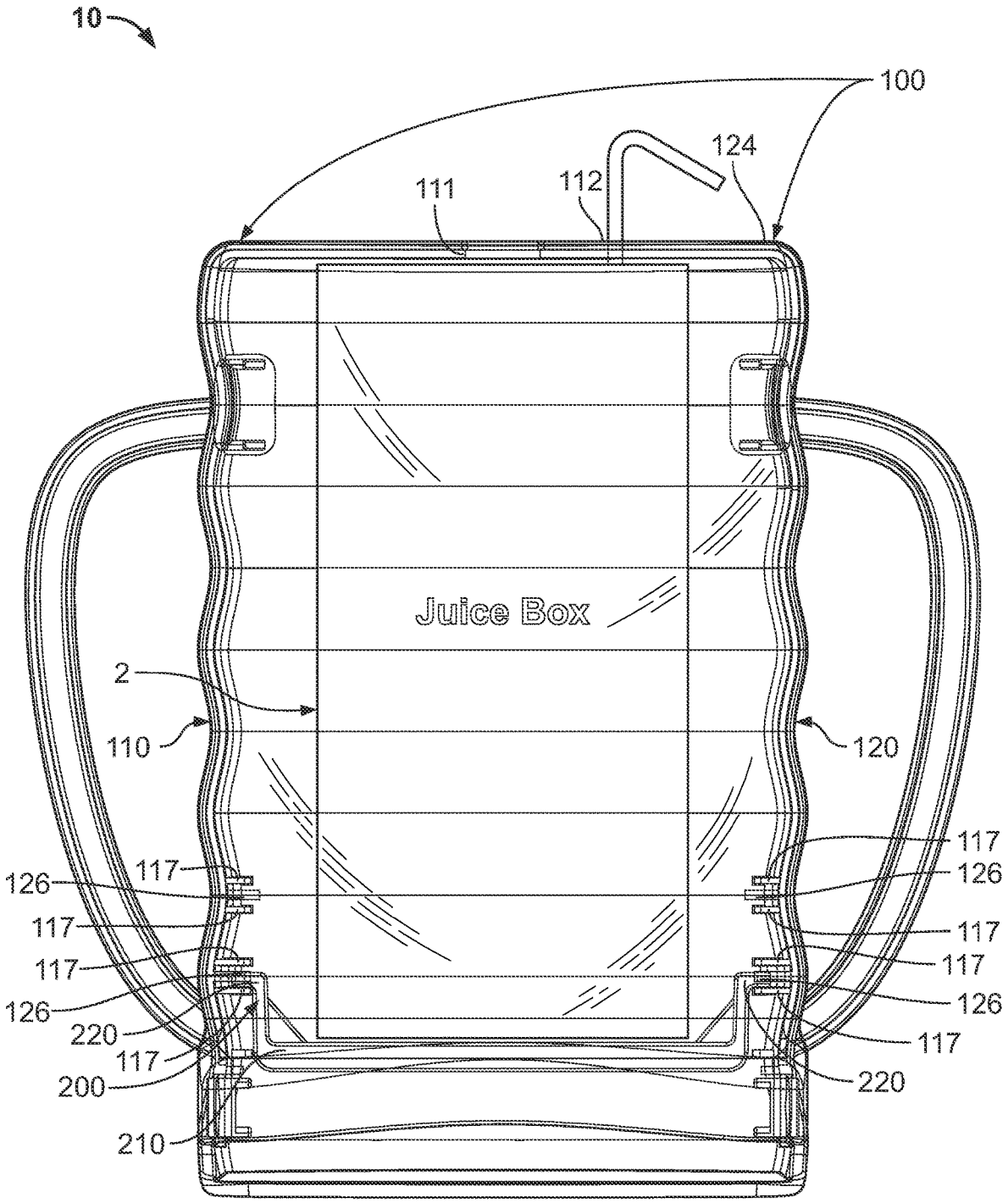
FIG. 10 illustrates a front elevation view of a holder containing a first type of packaged food item, according to embodiments.

For example, as shown in the embodiments of FIG. 10, when the shelf 200 is in the third configuration, the straw hole of the juice box is proximate to and below the aperture 112 in the upper portion 113 of the rear portion 110. The aperture 112 may be positioned in a horizontal location (e.g., width and/or depth location(s)) to correspond to the straw hole in the juice box 2. If, however, the shelf 200 is in a different configuration, the straw hole in the juice box 2 may not be at the predetermined area—e.g., it may be too high (i.e., the juice box 2 will not fit in the interior region of the housing 100) or too low (e.g., it may be difficult to insert the straw of the juice box 2 into the straw hole through the aperture 112, or the length of the straw exterior to the holder 10 may be too short or nonexistent).

Figure 11:
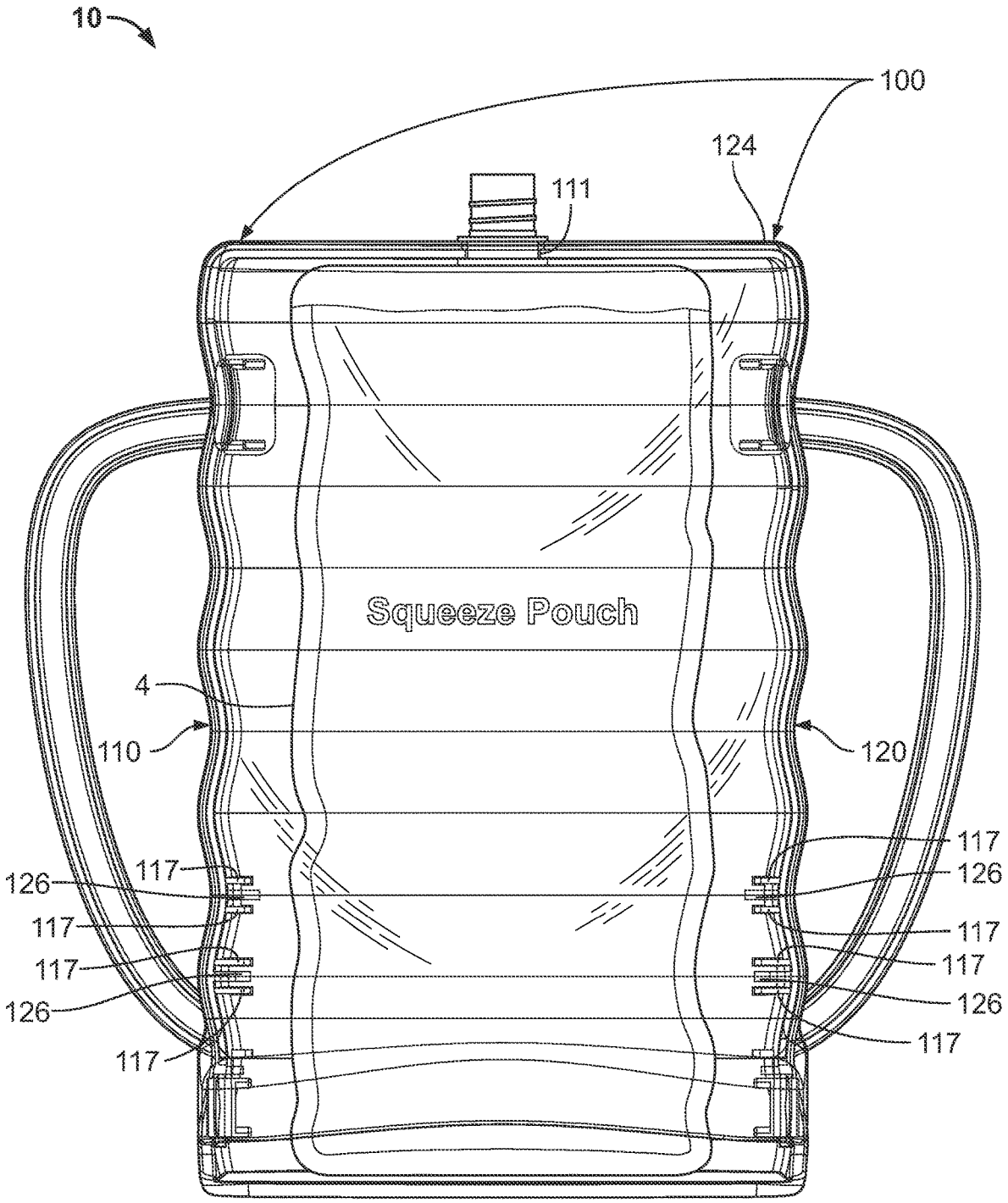
FIG. 11 illustrates a front elevation view of a holder containing a second type of packaged food item, according to embodiments.

As another example, in the embodiments of FIG. 11, if the shelf 200 is not in the fifth configuration (i.e., removed from the housing 100), an unused squeeze pouch 4 may not fit in the interior region of the housing 100. In this example, the lower recess in the shaft of the nozzle of the squeeze pouch 4 is at a predetermined area such that it corresponds to the elevation of the upper portion of the housing. This may be preferable to constrain vertical and horizontal movement of the nozzle while still allowing the cap to the nozzle (not shown) to be attached via the illustrated threads on the nozzle above the recess.

Parts List:

| Part | Reference |
|---|---|
| Juice box | 2 |
| Squeeze pouch | 4 |
| Holder | 10 |
| Housing | 100 |
| Rear portion of housing | 110 |
| Recess/aperture | 111 |
| Width | 111a |
| Width | 111b |
| Aperture | 112 |
| Upper portion of rear portion of housing | 113 |
| Handle | 114 |
| Lower portion of rear portion of housing | 115 |
| Aperture | 116 |
| Receiving feature | 117 |
| Ridges | 118 |
| Front portion of housing | 120 |
| Lower region of front portion of housing | 121 |
| Spring arm | 122 |
| Spring arm head | 123 |
| Upper portion of front portion of housing | 124 |
| Ridges | 125 |
| Constraining portion | 126 |
| Shelf | 200 |
| Resting portion of shelf | 210 |
| Insertion feature | 220 |

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A holder for holding at least one type of packaged food item that packages food, wherein the at least one type of packaged food item includes an outlet through which the food is accessed, the holder comprising:

a housing including an interior region in which to house one of the at least one type of packaged food item, wherein the housing includes an upper portion having at least one aperture, wherein the housing is configured to open to receive the one of the at least one type of packaged food item; and an adjustable shelf coupled with the housing, wherein the adjustable shelf is configured to have an adjustable elevation adjustable to a first elevation and a second elevation, wherein the adjustable shelf is configured to be a resting portion for the one of the at least one type of packaged food item, and wherein when the adjustable shelf is at the first elevation, the at least one type of packaged food item extends through the aperture in the upper portion of the housing such that the outlet is at a predetermined area exterior to the housing, and wherein when the adjustable shelf is at the second elevation, the outlet of the one of the at least one type of packaged food item is not at the predetermined area.

2. The holder of claim 1, wherein:

the aperture is at a third elevation; and wherein a distance between the first elevation and the third elevation is between approximately 5.22-5.42 inches.

3. The holder of claim 2, wherein a width of the aperture is between approximately 0.44-0.64 inches.

4. The holder of claim 1, wherein when the housing comprises at least one first receiving feature to receive the adjustable shelf and at least one second receiving feature to receive the adjustable shelf, wherein the at least one first receiving feature is above the at least one second receiving feature.

5. The holder of claim 4, wherein when the adjustable shelf is received by the at least one first receiving feature, the adjustable shelf is adjustable into a plurality of elevations.

6. The holder of claim 5, wherein the at least one first receiving feature comprises a plurality of slots, and wherein the at least one second receiving feature comprises a plurality of slots.

7. The holder of claim 6, wherein the adjustable shelf comprises at least one insertion feature and a resting portion upon which the one of the at least one type of packaged food item is configured to rest, wherein the at least one insertion feature is selectively receivable by the at least one first receiving feature and by the at least one second receiving feature, and wherein the resting portion of the adjustable shelf has a different elevation than the at least one insertion feature.

8. The holder of claim 1, wherein the housing includes a lower portion, wherein the adjustable shelf is removable from the interior region of the housing, and wherein when the adjustable shelf is removed from the interior region of the housing, the interior region of the housing is configured to receive the one of the at least one type of packaged food item such that the one of the at least one type of packaged food item rests on the lower portion of the housing.

9. The holder of claim 1, wherein the housing comprises a front portion including a hinge portion in a lower region of the front portion, and wherein the front portion is hingedly coupled to another portion of the housing, such that the front portion rotates downwardly to allow placement of the one of the at least one type of packaged food item into the interior region of the housing.

10. The holder of claim 9, wherein the housing includes at least one spring configured to selectively secure the front portion of the housing to another portion of the housing to form the interior region of the housing.

11. A holder for holding at least one type of packaged food item for food, wherein the at least one type of packaged food item includes an outlet through which the food is accessed, the holder comprising:

a housing including:

a first portion including an upper portion, a lower portion, a at least one receiving feature, and at least one hinge feature, wherein the upper portion comprises a recess, wherein the recess is configured to receive a nozzle of one of the at least one type of packaged food item; and a second portion including at least one hinge feature coupled with the at least one hinge feature of the first portion to form a hinge, such that the second portion is rotatable with respect to the first portion; and a removable shelf including a resting portion and at least one insertion feature, wherein the at least one insertion feature is configured to be received by the at least one receiving feature.

12. The holder of claim 11, wherein the resting portion of the removable shelf is at a different elevation than the at least one insertion feature of the removable shelf when the at least one insertion feature is received by the at least one receiving feature of the first portion of the housing.

13. The holder of claim 12, wherein the first portion of the housing comprises a second at least one receiving feature, and wherein the at least one insertion feature of the removable shelf is configured to be received by the second at least one receiving feature of the first portion of the housing.

14. The holder of claim 11, wherein the first portion of the housing comprises a second at least one receiving feature, and wherein the at least one insertion feature of the removable shelf is configured to be received by the second at least one receiving feature of the first portion of the housing.

15. The holder of claim 11, wherein the first portion of the housing comprises an opaque material, and the second portion of the housing comprises at least one of a transparent material or a translucent material.

16. The holder of claim 11, wherein each of the at least one hinge feature of the second portion of the housing is located in a lower region of the second portion of the housing.

17. The holder of claim 11, wherein the recess in the upper portion of the first portion of the housing comprises a width between approximately 0.44-0.64 inches.

18. The holder of claim 11, wherein a distance between the upper portion and lower portion of the housing is between approximately 5.45-5.65 inches.

19. The holder of claim 11, wherein the housing includes at least one spring configured to selectively secure the first portion of the housing to the second portion of the housing.

20. The holder of claim 19, wherein the at least one spring is located on the second portion of the housing.

* * * * *